US008162450B2

(12) United States Patent
Barbet

(10) Patent No.: US 8,162,450 B2
(45) Date of Patent: Apr. 24, 2012

(54) PRINTING BY DEFLECTING AN INK JET THROUGH A VARIABLE FIELD

(75) Inventor: Bruno Barbet, Etoile sur Rhone (FR)

(73) Assignee: Markem-Imaje, Bourg-les-Valence (FR)

( * ) Notice: Subject to any disclaimer, the term of this patent is extended or adjusted under 35 U.S.C. 154(b) by 256 days.

(21) Appl. No.: 12/443,407

(22) PCT Filed: Oct. 4, 2007

(86) PCT No.: PCT/EP2007/060538
§ 371 (c)(1),
(2), (4) Date: Mar. 27, 2009

(87) PCT Pub. No.: WO2008/040777
PCT Pub. Date: Apr. 10, 2008

(65) Prior Publication Data

US 2010/0045753 A1 Feb. 25, 2010

Related U.S. Application Data

(60) Provisional application No. 60/872,092, filed on Jan. 26, 2007.

(30) Foreign Application Priority Data

Oct. 5, 2006 (FR) ..... 06 54112

(51) Int. Cl.
*B41J 2/105* (2006.01)

(52) U.S. Cl. ..... 347/82

(58) Field of Classification Search ..... 347/82, 347/73–79, 80, 81, 90
See application file for complete search history.

(56) References Cited

U.S. PATENT DOCUMENTS

| | | | |
|---|---|---|---|
| 3,373,437 | A | 3/1968 | Sweet et al. |
| 3,596,275 | A | 7/1971 | Sweet |
| 4,346,387 | A | 8/1982 | Hertz |
| 4,350,986 | A | 9/1982 | Yamada |
| 4,547,785 | A | 10/1985 | Jones |
| 5,070,341 | A | 12/1991 | Wills et al. |
| 6,273,559 | B1 | 8/2001 | Vago et al. |
| 7,273,270 | B2 | 9/2007 | Katerberg |
| 7,364,276 | B2 | 4/2008 | Piatt et al. |
| 7,712,879 | B2 | 5/2010 | Barbet |
| 2003/0156169 | A1 | 8/2003 | Martin et al. |
| 2003/0222950 | A1 | 12/2003 | Jeanmaire |
| 2009/0231398 | A1 | 9/2009 | Barbet |

FOREIGN PATENT DOCUMENTS

EP 0 013 504 A1 7/1980

(Continued)

OTHER PUBLICATIONS

International Search Report, PCT/EP2007/060538, dated Jan. 10, 2008.

(Continued)

*Primary Examiner* — Kristal Feggins
(74) *Attorney, Agent, or Firm* — Nixon Peabody LLP

(57) ABSTRACT

For printing, the principle of the continuous deflected jet is used: a device discharges a continuous stream of a liquid, which is deflected by an electric field created by a plurality of deflecting electrodes and directed toward a gutter. The printing of drops is performed by fragmenting the continuous jet into a segment formed opposite a shield electrode upstream of the deflecting electrode, so that the segment is not deflected and can be directed toward a substrate.

The deflection electrodes are separated by an insulator and a variable potential is applied to each electrode; the potential for the entire set of electrodes cancels out such that the jet is not charged.

21 Claims, 3 Drawing Sheets

FOREIGN PATENT DOCUMENTS

| | | | |
|---|---|---|---|
| EP | 0 911 161 | A2 | 4/1999 |
| EP | 0 911 165 | A2 | 4/1999 |
| EP | 0 911 166 | A2 | 4/1999 |
| EP | 0 911 167 | A2 | 4/1999 |
| EP | 0 949 077 | A1 | 10/1999 |
| EP | 1 092 542 | A1 | 4/2001 |
| EP | 1219429 | | 7/2002 |
| GB | 1 521 889 | | 8/1978 |
| GB | 1 528 269 | | 10/1978 |
| JP | 59014970 | | 1/1984 |
| JP | 60004065 | | 1/1985 |
| WO | 88/01572 | A1 | 3/1988 |

OTHER PUBLICATIONS

International Search Report, PCT/EP2006/067268, dated Feb. 13, 2007.

French Preliminary Search Report, FR 0654112, dated May 7, 2007.

French Preliminary Search Report, FR 05 53117, dated Aug. 30, 2006.

Notice of Allowance in U.S. Appl. No. 11/991,508, mailed Dec. 29, 2009.

Office Action (Supplemental Notice of Allowability) in U.S. Appl. No. 12/083,388, mailed Nov. 7, 2011.

Notice of Allowance in U.S. Appl. No. 12/083,388, mailed Sep. 8, 2011.

Office Action in U.S. Appl. No. 12/083,388, mailed Mar. 17, 2011.

International Search Report and Written Opinion in International Application No. PCT/EP2006/066248, dated Jan. 16, 2007.

International Preliminary Search Report and Written Opinion in International Application No. PCT/EP2006/066248, dated Nov. 19, 2007.

International Preliminary Report on Patentability in International Application No. PCT/EP2006/067268, dated Jan. 7, 2008.

International Preliminary Report on Patentability in International Application No. PCT/EP2007/060538, dated Dec. 12, 2008.

PRINTING BY DEFLECTING AN INK JET THROUGH A VARIABLE FIELD

CROSS REFERENCE TO RELATED APPLICATIONS or PRIORITY CLAIM

This application is a national phase of International Application No. PCT/EP2007/060538, entitled "PRINTING BY DEFLECTING AN INK JET THROUGH A VARIABLE FIELD", which was filed on Oct. 4, 2007, and which claims priority of French Patent Application No. 06 54112, filed Oct. 5, 2006 and U.S. Provisional Patent Application No. 60/872,092, filed Jan. 26, 2007.

DESCRIPTION

1. Technical Field

The invention is in the field of liquid projection that is inherently different from atomization techniques, and more particularly of controlled production of calibrated droplets, for example used for digital printing.

The invention relates particularly to deviation of an ink jet, which enables selective deviation of droplets relative to a flow for which one preferred but not exclusive application field is ink jet printing. The device and method according to the invention relate to any asynchronous liquid segment production system in the continuous jet field, as opposed to drop-on-demand techniques.

2. Background Art

Typical operation of a continuous jet printer may be described as follows: electrically conductive ink is kept under pressure in an ink reservoir which is part of a print head comprising a body. The ink reservoir comprises particularly a chamber that will contain ink to be stimulated, and housing for a periodic ink stimulation device. Working from the inside outwards, the stimulation chamber comprises at least one ink passage to a calibrated nozzle drilled in a nozzle plate: pressurized ink flows through the nozzle, thus forming an ink jet which may break up when stimulated; this forced fragmentation of the ink jet is usually induced at a point called the drop break up point by the periodic vibrations of the stimulation device located in the ink contained in the ink reservoir.

Such continuous jet printers may comprise several print nozzles operating simultaneously and in parallel, in order to increase the print surface area and therefore the print speed.

Starting from the break up point, the continuous jet is transformed into a sequence of ink drops. A variety of means is then used to select drops that will be directed towards a substrate to be printed or towards a recuperation device commonly called a gutter. Therefore the same continuous jet is used for printing or for not printing the substrate in order to make the required printed patterns.

The selection conventionally used is the electrostatic deflection of drops from the continuous jet: a first group of electrodes close to the break up point and called charging electrodes selectively transfers a predetermined electrical charge to each drop. All drops in the jet, some of which having been charged, then pass through a second arrangement of electrodes called the deflection electrodes generating an electric field that will modify the trajectory of the drops depending on their charge.

For example, the deviated continuous jet variant described in document U.S. Pat. No. 3,596,275 (Sweet) consists of providing a multitude of voltages to charge drops with a predetermined charge, at an application instant synchronized with the generation of drops so as to accurately control a multitude of drop trajectories. According to another variant, the positioning of droplets on only two preferred trajectories associated with two charge levels results in a binary continuous jet print technology described in document U.S. Pat. No. 3,373,437 (Sweet).

However, this technique has a number of limitations:

- The polarity of the potential applied to the deflection electrode always has the same sign, which means that the electrode cannot be protected by an electrical insulator to eliminate any risk of a short circuit between the jet and the electrode. Furthermore, the high voltage generator then has to be put adjacent to electronics providing efficient protection against short circuits, which is costly.
- Electrical charges present on the jet surface close to the charge electrode originate from the nozzle plate usually connected to the ground. The kinetics of the transport of these charges along the jet imposes a strong constraint on ink properties, with required minimum conductivity.
- It is necessary to have a measurement of the charge of drops and a servo control to synchronize the application of electrical potentials for charging drops with the signal that stimulates controlled fragmentation of the jet.
- The size of printable drops is fixed, so that it is impossible to create a continuous range of gray shades in printed images.
- If multiple jets are used, charge electrodes placed close to each jet must be connected and controlled individually.

Another approach consists of setting the charging potential and varying the stimulation signal to move the jet break up location: the quantity of charge carried by each drop and consequently the drop trajectory will be different, depending on whether the drop is formed close to or far from a charging electrode common to all jets. The set of charging electrodes may be more or less complex: a multitude of configurations is explored in document U.S. Pat. No. 4,346,387 (Hertz). The main advantage of this approach is the mechanical simplicity of the electrode block, but transitions between two deflection levels cannot be easily managed: the transition from one break up point to another produces a series of drops with uncontrolled intermediate trajectories.

Solutions have been considered to overcome this difficulty comprising a modulation of the break length in EP 0 949 077 (Imaje), but with a tight tolerance on the break up length (typically a few tens of microns) that is difficult to control; or management of partially charged portions of the jet with a length equivalent to the distance separating two clearly defined break up locations in EP 1 092 542 (Imaje), but this requires management of two break up points and the useful drop generation frequency has to be reduced, with the production of unusable jet segments.

An alternative to the selective deflection of drops involves the direct deflection of the continuous jet, for example, by means of a static or variable electrostatic field.

For example, document GB 1 521 889 (Thomson) discloses this technology, with substantial deflection of a jet by causing the amplitude of the electrostatic field to vary, so that the jet enters or leaves a gutter according to printing requirements. However, the management of transitions is problematic: the jet hits the edge of the gutter and pollutes it. This technique also has some of the same disadvantages as the classical deviated continuous jet, namely that it is impossible to isolate deflection electrodes, and the constraint on ink conductivity.

One variant described in WO 88/01572 (Wills), consists of deflecting the jet and amplifying its deflection by means of a set of electrodes to which time shifted voltage pulses are applied, with phase shift that depends on the jet advance speed; when the deflection amplitude is sufficient, deflected jet portions naturally detach from the continuous jet and the end of the jet produces drops that are either collected in a gutter or are projected to a medium to be printed. Apart from the fact that it is impossible to protect electrodes with a dielectric, since all voltages have the same polarity, a disadvantage inherent to this principle is the need of having a servo control to synchronize the application of potentials with the jet advance speed. Furthermore, the jet advance speed relative to the electrodes mobilizes charges from the nozzle plate that makes it impossible to break the jet on the upstream side of the deflection zone (zone of influence of the electrodes): a break in the jet interrupts electrical continuity of the jet and prevents transfer of charges.

In general, even for recent developments such as those of the Kodak company for its drop generator based on a heat stimulation technique allowing for unusual drop production regimens, all of the solutions proposed for jet deflection (heat EP 0 911 166, electrostatic EP 0 911 167, hydrodynamic EP 0 911 165, Coanda effect EP 0 911 161, and so on), without exception, present the problem of transitions between deflected and undeflected jets.

For example, in EP 0 911 167, a curtain of jets is deviated by an electrode to which a constant high voltage potential is applied; the two static states (jet in the deflected and undeflected position) are handled correctly, but the production of jet segments with intermediate trajectories generates pollution and splashes on the substrate to be printed. Once again, since the high voltage potential is constant, the same disadvantages arise as for the previous options: constraint on the conductivity of liquids, impossibility of electrically protecting the deflection electrode.

SUMMARY OF THE INVENTION

One of the advantages of the invention is to overcome the disadvantages of existing print heads; the invention relates to the management of deflection of liquid jet segments, while protecting the deflecting electrodes and allowing use of less conductive ink.

The invention thus relates to a printing technique based on selective deflection of liquid segments drawn off from a continuous liquid jet, the segment deviation device being located on the downstream side of the jet disturbance and more precisely on the downstream side of the jet segment production zone jet segments being defined as liquid cylinders delimited by two jet breakage points). The trajectory of segments is controlled by means of a set of deflection electrodes to which potentials variable in time are applied, but for which the average in space and in time is practically zero, preferably high voltage sinusoidal phase shifted signals. In particular, all the time, the quantities of positive and negative charges induced on the jet by the electrodes are practically equal, to assure that the jet is electrically neutral in the zone of influence of the electrodes. There is little or no circulation of electrical charges over large distances in the jet, particularly between the nozzle and the zone of electrical influence of the electrodes.

The sorting system of liquid segments according to the invention is particularly suitable for multi-jet printing since the deflection level is binary and can be common to a large number of jets.

More generally, the invention relates to a method for deflecting a jet of conducting liquid, such as ink, formed from a pressurized chamber and issuing from a nozzle along a hydraulic trajectory at a predetermined speed. A variable electric field is generated along the hydraulic trajectory, to deviate the jet. The electric field is generated by applying a potential to several electrodes positioned along the hydraulic trajectory of the jet, in other words along the center line of the nozzle, over a first length of the set of electrodes; electrodes isolated from each other are arranged approximately in line along the hydraulic trajectory, and the dimension of each electrode along the direction of the trajectory is preferably the same and it is separated from the adjacent electrode by a distance that is advantageously constant, for example by an insulator. The potential, particularly a high voltage signal, applied to each electrode is variable, particularly periodically, for example sinusoidal, and the set of potentials applied to the set of electrodes is of an average in time and in space equal to zero; preferably, the set comprises an even number of electrodes and the frequency and amplitude of the potential applied to two adjacent electrodes are identical but in phase opposition.

Applying a potential of this nature forms dipoles within the jet by the mobilization of liquid ions facing the electrodes in the network; local jet charges deviate the jet. Preferably, the jet itself derivates from a reservoir and a nozzle connected to the ground.

Advantageously, if the distance separating the network of electrodes from the hydraulic trajectory of the jet is less than twice the insulation distance separating two adjacent electrodes from each other, so as to obtain maximum deviation.

Preferably, if the length of the network of electrodes is superior to the ratio between the jet speed and the frequency of the high voltage signal applied to the electrodes, for example at least five times this ratio, to achieve an approximately constant amplitude of the jet deviation.

According to another aspect, the invention relates to a method for selective deflection of segments issued from a continuous jet as a function of their length. The method includes a method of deviating the jet like that defined above and applying a disturbance to the jet so as to break it and generate segments. The jet break up point is preferably on the upstream side of the electric field, for example protected by a shielding, and advantageously at a constant distance from the nozzle.

The generated segments may have different lengths. It is preferable to have long segments, in other words, segments for which the length is superior to or equal to the length of the network of electrodes, alternating with short segments, preferably shorter than the smallest distance separating two adjacent electrodes: the long segments will be deviated with a maximum amplitude and for example can be recovered in a gutter, and the short segments will not be deviated or will be deviated by a small amount and can be used for example for printing. Advantageously, the short segments that form drops by surface tension will not carry an electrical charge.

In one preferred application, the method is used for ink jet printing and the jet disturbance is created by activating a piezoelectric actuator. It is preferable for a multitude of nozzles and actuators to act simultaneously to form a curtain of jets and/or drops. In this case, it is advantageous if the network of electrodes and/or the shielding of the break up point, and the recovery gutter, are common for all jets.

The invention also relates to an adapted device capable of selective deviation of drops of conducting liquid, for example ink. The device comprises at least one reservoir of pressurized liquid with a liquid ejection nozzle in the form of a continuous jet along a hydraulic trajectory, preferably, the device comprises a plurality of reservoirs, possibly in line, to form a curtain of drops.

Each reservoir in the device according to the invention is associated with means of disturbing the jet and breaking it at a jet break up point, for example piezoelectric actuators.

Preferably, the system is such that the jet break up point is at a constant distance from the nozzle, and it may be advantageous to put shielding into place at this position, for example an electrode. Reservoirs and their nozzles are preferably connected to the ground.

The device according to the invention also comprises a set of electrodes, preferably a set common for all nozzles, positioned along the hydraulic trajectory and extending over a determined length. The network comprises a plurality of deflection electrodes in sequence along this hydraulic trajectory, advantageously identical to each other and separated by a preferably constant distance, for example by an insulator. In one particularly advantageous embodiment, the number of electrodes is even.

Finally, the device comprises means of applying a variable potential, for example sinusoidal, to the electrodes. The means are also such that the averages in space and in time of the potential applied to all the electrodes in the network is zero. In particular, it is preferable if the frequency and amplitude of the potential applied to two adjacent electrodes in the network are identical but in phase opposition. Application of this potential generates an electric field that deviates the jet from its hydraulic trajectory.

According to one preferred embodiment, the network of electrodes is covered by an electrically insulating film, preferably with a thickness such that the ratio between the amplitude of the high voltage signal applied to the electrodes and the film thickness is less than the dielectric strength of the insulation.

Advantageously, the distance between the network of electrodes and the longitudinal axis of the ejection nozzle, in other words the hydraulic trajectory, is less than twice the distance separating two adjacent electrodes in the network.

The device may also comprise a recovery gutter for liquid contained in the deviated jets.

Finally, the invention relates to a print head comprising a device like that presented above and/or operating according to the principle described above.

BRIEF DESCRIPTION OF THE DRAWINGS

Other characteristics and advantages of the invention will become clearer after reading the following description with reference to the attached drawings, given as illustrations and that are in no way limitative.

DETAILED PRESENTATION OF PARTICULAR EMBODIMENTS

In the printing principle according to the invention, and as described in patent application FR 05 53117 (Imaje), the continuous jet formed by the print head is deviated by means of an electrode to which a static or sinusoidal high voltage is applied, and most of which will not be printed; for printing, segments of the ink jet are sampled asynchronously, deviated differently depending on their length (the length providing a means of varying the embedded electrical charge per unit length) and directed towards the substrate. These portions, that can be transformed into spherical drops under the effect of the surface tension, are detached from the jet before it is deflected such that their trajectory is different, with the system generally functioning in binary mode.

Figure 1A:
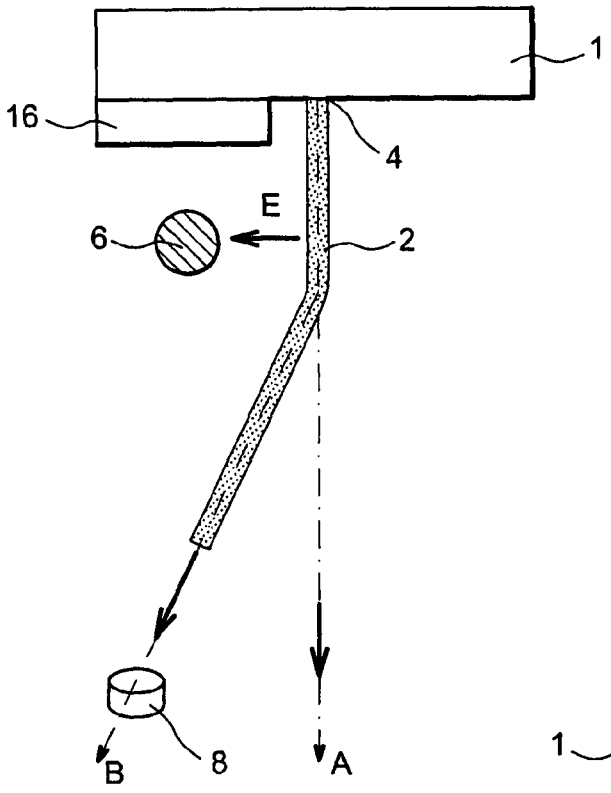
FIGS. 1A and 1B illustrate the method of deflecting a continuous jet by an electric field.

In particular, as shown in FIG. 1A, in the non-printing situation, a drop generator 1, which is, for example, activated by a piezoelectric device, forms a continuous liquid jet 2 along a hydraulic trajectory. The jet 2 discharged by the nozzle 4 of the generator 1 at a predetermined speed v is deflected from the axis A of the nozzle 4, namely the hydraulic trajectory, by means of an electric field E; the electric field E might be created by an electrode 6.

The electrode 6, which is preferably brought to a high potential, forms a capacitor with the jet 2: the attractive force between the two jet/electrode capacitor plates 2, 6 is primarily dependent on the potential squared difference and on the distance between the jet 2 and the electrode 6. The jet 2 trajectory is therefore modified.

On the downstream side of the electrode 6, the jet 2 continues its trajectory along the tangent to its trajectory at the output from the zone of the electric field E, to be directed along a deviated trajectory B towards an ink recovery gutter 8.

According to the speed of the jet v, it is thus possible to determine the angle formed between the deflected trajectory B and the hydraulic trajectory A, as well as the length of the print head or the distance between the nozzle 4 and the gutter 8.

Figure 1B:
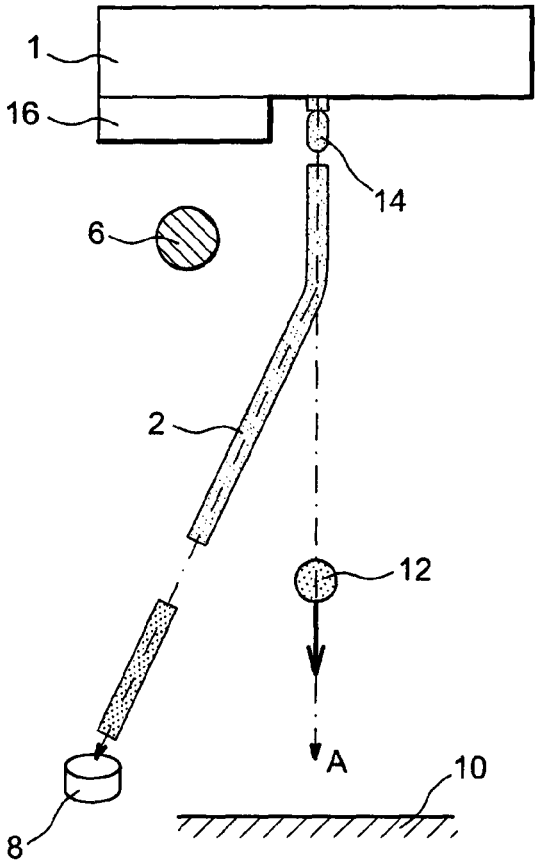

The printing of an ink drop 12 on a substrate 10 requires the jet 2 to be broken twice so as to delimit a segment of liquid 14 which will form, by way of surface tension, said drop 12: FIG. 1B. The segment 14 is short and unaffected by the field E. Preferably, it is not subjected to the deflection by the electrode 6 and the break up point of the jet 2 is located at the level of a shield, such as an electrode 16 brought to the same potential as the liquid and the nozzle 4, which shields the break up point from the electric field E produced by the deflecting electrode 6, so that the electric charge borne by the short segment 14 is zero, or very low. Consequently, the jet segment 14 is not, or is very slightly, deflected when it passes in front of the deflecting electrode 6, and its trajectory is close to the hydraulic trajectory A of the jet 2 being discharged from the nozzle 4. The formed segment 14 and the resulting drop 12, therefore, are not intercepted by the ink collection gutter 8, but can be directed to a substrate 10 to be printed.

In this configuration, if the potential applied to the electrode 6 is constant as for other systems according to prior art, the electrode cannot be protected by an insulating film because the surface of the insulating film stores electrical charges that disturb the electric deflection field. Furthermore, the jet must be placed at a significant distance from the electrode to prevent any accidental projection of ink from the jet 2 onto the electrode 6, which can cause a short circuit between the jet and the electrode. The risk of a short circuit and the possible resulting damage to parts make it necessary to install an efficient electronic protection system adjacent to the high voltage generator, and this is expensive. In practice, short circuits cannot always be avoided, and they cause the electrical power supply to go off, the jet 2 is then no longer deflected, nor is it collected by the gutter 8, and the result is that the print support 10 becomes covered with unwanted ink.

Furthermore, if the field E in this same configuration is made variable, the transfer of charges between the nozzle plate 4 and the zone influenced by the electrode 6 makes it necessary to synchronize the instant at which drops 12 are formed with the high voltage signal. This synchronization between the application of electrical potentials that will charge or deviate drops with signals controlling fragmentation of the jet also makes it necessary to have a measurement of the charge of drops and/or slaving.

Finally, dependence between the jet break process (deformation of the jet 2 to form drops 12) and the rate of charge of the jet 2 is difficult to control and imposes constraints on the physicochemical properties of inks.

Figure 2A:
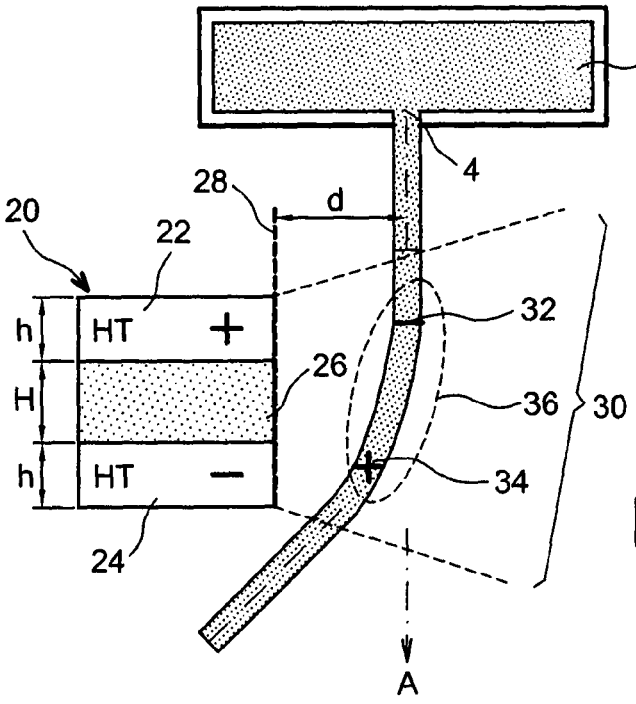
FIGS. 2A and 2B show a deflection according to preferred embodiments of the invention.
Figure 2B:
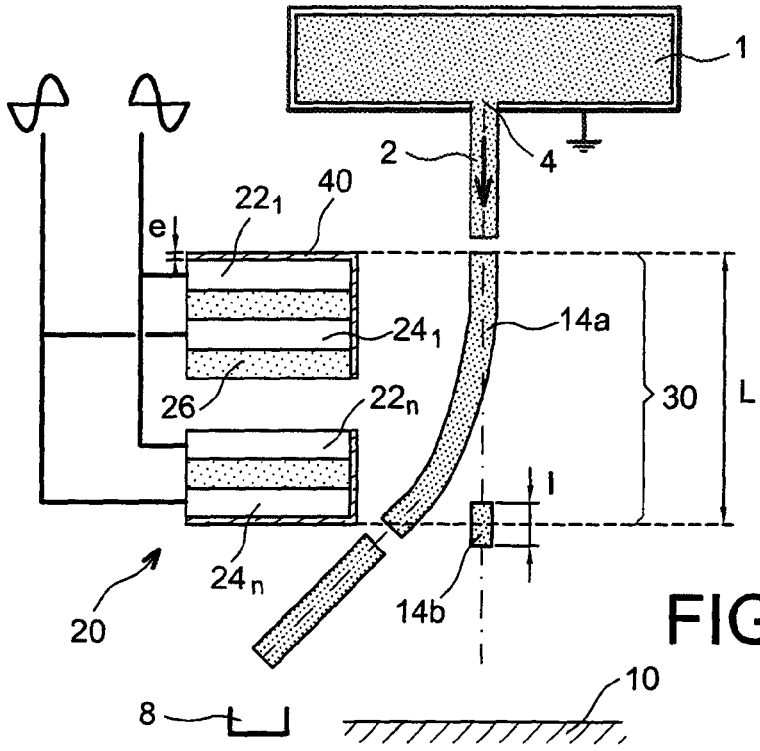
Figure 3:
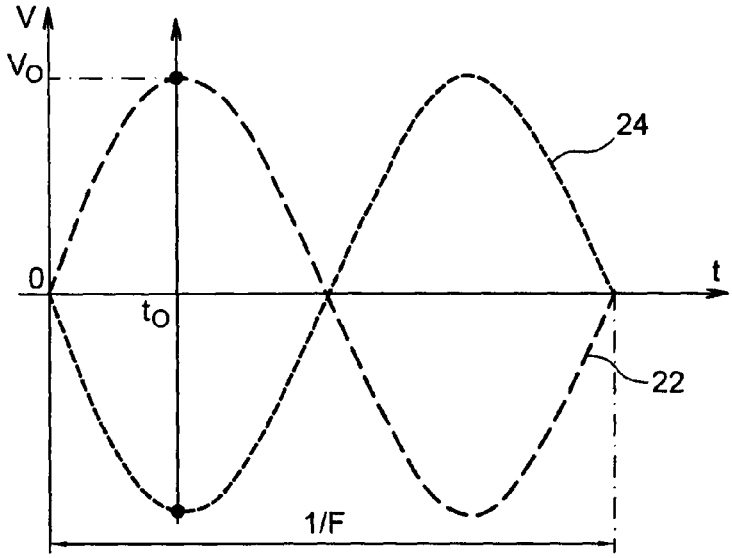
FIG. 3 shows a high voltage signal used in a preferred deflection method according to the invention.

These problems are overcome by making the electric field E applied to the jet 2 variable, and by using a set 20 of multiple deflection electrodes powered with variable potentials—see FIGS. 2 and 3.

In particular, the set of electrodes 20 used in a device and for a method according to the invention is such that the average of the electric field E in time is equal to zero, or almost zero, such that the jet 2 is electrically neutral in the zone of influence of the electrodes 20; however, the positive and negative charges distributed in the jet 2 by the network of electrodes 20 are separated, such that a deflection is possible. Thus, the quantity of positive charge induced on the jet 2 at any time by electrodes in the network 20 powered by a negative signal is almost equal to the quantity of negative charge induced on the jet 2 by the electrodes powered with a positive signal. Therefore there is no or little circulation of electrical charges over long distances in the jet 2, particularly between the nozzle 4 and the zone of electrical influence of the electrodes 20. Thus, it is possible to use low conductivity inks: the need to mobilize electrical charges from the nozzle plate 4 (usually connected to the ground) to the zone of influence of the electrode 6 would impose strong constraints on the conductivity of inks.

In one preferred embodiment that consists of acting on the jet 2 by means of an even number of electrodes (for example a pair of electrodes 22, 24) with the same geometry, the electrical signals for each electrode have the same amplitude, frequency and shape, but are out of phase (in phase opposition for the pair of electrodes).

Furthermore, the preferred application relates to <<multi-jets >>, in other words a plurality of nozzles 4, usually in line, enables the ejection of a plurality of parallel jets 2, forming one or several planes depending on the layout of the nozzles. The electrodes 20 can then be common to all jets 2, themselves each generated individually by a generator 1.

According to this first embodiment illustrated on FIG. 2A, the set of electrodes 20 thus comprises two electrodes 22, 24 with exactly the same dimension h along the direction of the hydraulic trajectory A, separated by an electrical insulator 26 with dimension H. Each electrode 22, 24 is powered by a variable high voltage signal with a given amplitude $V_0$, and identical frequency F and shape but with a phase shift between them; in particular, as illustrated in FIG. 3, they are two sine curves with a phase shift of 180°. The electrodes 22, 24 and the insulation 26 are preferably at the same distance d from a hydraulic trajectory A defining a cut line, in other words an electrodes plane 28 in the case in which there is a multitude of nozzles 4; the zone of influence 30 of the electrodes 20 extends outwards from the electrodes plane 28 towards the jet 2, over a short distance.

At a given instant to, the first electrode 22 with a positive charge induces a charge with the opposite sign (−) on the surface of the facing jet 2, creating an attraction force between the electrostatically influenced portion 32 of the jet and the electrode 22. Similarly, the negatively charged electrode 24 induces a charge of the opposite sign (+) on the portion 34 of jet 2 facing it, thus creating an attraction force proportional to the square of the induced charge. The jet 2 is deviated from its hydraulic trajectory A under the action of the forces created by the two electrodes 22, 24, and tends to move towards the electrodes 20.

In this configuration that is fully symmetric with regard to the signal and also the geometry of the electrodes 22, 24, the electrostatic action induces an electrical dipole 36 in the jet 2, the charges involved in the dipole 36 originating from separation of the positive and negative charge carriers (ions) inside the jet 2. Note that this charge separation phenomenon is quite unlike the charge transfer mechanism based on conduction from the nozzle plate 4 (in which for example the jet 2 may be connected to the ground) to the zone 30 of influence of the electrodes 20. In particular, the jet 2 remains at zero average charge if the ink, the reservoir and the nozzle 4 are connected to the ground.

The result is thus a deflection of a continuous jet 2 by means of local charges, without charging the complete jet.

Obviously, since the required effect is to achieve electrical neutrality of the jet in the zone 30 of influence of the electrodes 20 while separating positive and negative charges, any combination of electrodes (size, potential, distribution, number) capable of satisfying these two conditions also satisfies the sorting principle for jet segments according to the invention. FIG. 2B illustrates one example in which the set of electrodes 20 comprises an alternation of electrodes $\mathbf{22}_i$ that are at the same potential as the electrodes $\mathbf{24}_i$ at the inverse potential; the electrodes are separated by insulators 26, preferably with the same dimensions and the same nature as each other.

Figure 4:
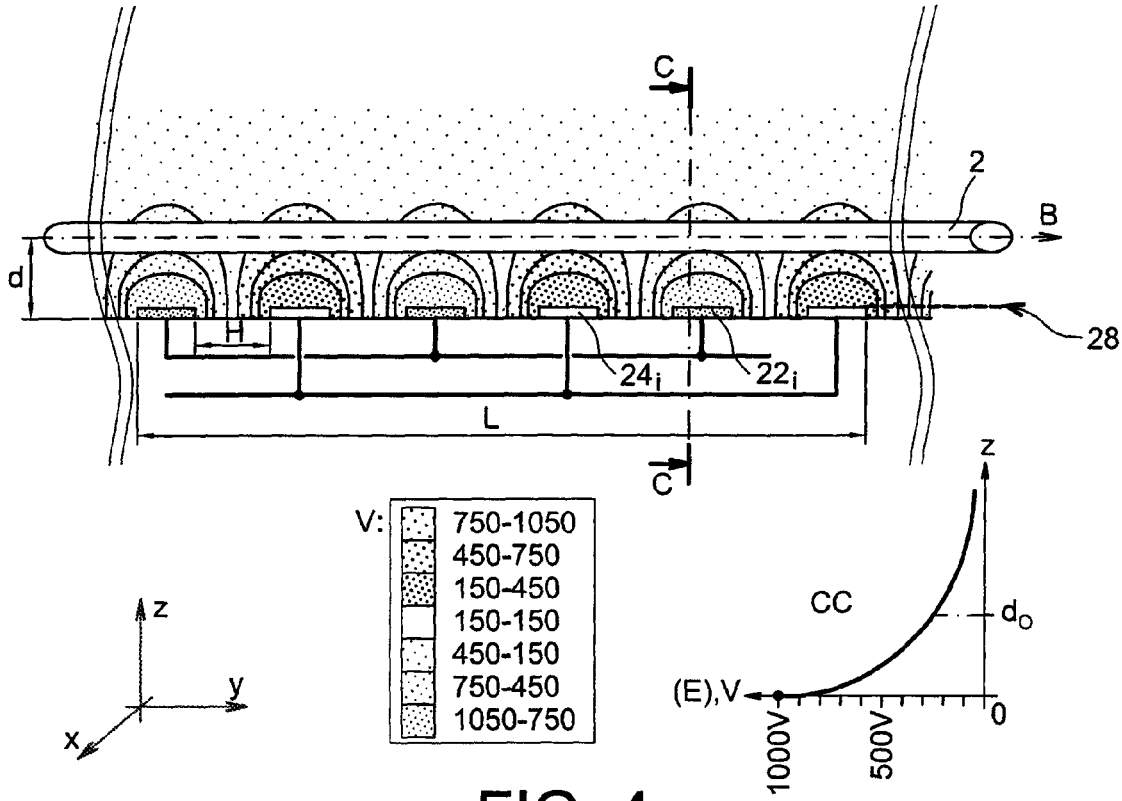
FIG. 4 show the variation of potentials for an arrangement of electrodes according to one embodiment of the invention.

The electric field E radiated by the electrodes 22, 24 quickly tends towards zero as the distance from them increases, due to the compensation effect between electrodes. For example, for an amplitude $V_0$ of potential 1000 V applied sinusoidally on a set of electrodes 22, 24, FIG. 4 shows that the potential V quickly tends towards zero as the distance from the plane 28 (x,y) of the electrodes increases (along the z axis), since the effects of the electrodes $\mathbf{22}_i$, $\mathbf{24}_i$ cancel out at a long distance. Naturally, for other embodiments, the distribution of potentials close to the set of electrodes 20 may be different, but the profile and result are similar; the decrease in the field E along the z axis, proportional to the potential V, typically follows a decreasing exponential curve, and a maximum significant electrostatic actuation distance do can be defined beyond which the field E is weak or even negligible.

The jet 2 is located sufficiently close to the electrodes 20 so that the attraction force applied to the jet 2 is significant; in particular, in the case of a multi-jet print head, each nozzle 4 is located on the same straight line, the plane formed by the hydraulic trajectories A being separated from the plane 28 of the electrodes by a distance d less than or equal to twice the insulation distance H between two adjacent electrodes 22, 24, otherwise the jet deflection amplitude will be reduced: $d \leqq 2 \cdot H \leqq d_0$ (in the case of a plurality of non-aligned nozzles 4, it is preferable that each jet 2 satisfies this condition related to the separation distance d from the electrodes plane 28).

Electric fields have to be intense in order to obtain maximum deflection efficiency; they influence the electrodes environment and create electrostatic precipitation type problems (dust and splashes become electrically charged and are deposited on the conductors) or electromagnetic compatibility problems. Thus, this type of ink collection on the electrodes can be minimized with the invention because the electric field remains confined as close as possible to the electrodes, which correspondingly increases the reliability and reproducibility of the jet deflection.

Furthermore, in order to completely avoid the risk of electrical breakdown between the electrodes 20 and/or the jet 2, with the invention it is possible to cover the electrodes network 20 by an electrically insulating film 40. Since the high voltage potential is variable, the force field E acting on the jet 2 is not disturbed by the accumulation or dissipation of electric charges on the outside surface of the insulator 40 (uncontrolled surface potentials). The thickness e of the insulator 40 will preferably be chosen so as to resist the high voltage even if the ink that conducts electricity and is grounded, accidentally covers/pollutes the surface of the dielectric 40 (in this case, the entire potential drop takes place within the thickness e of the dielectric 40). Preferably, the thickness e of the dielectric 40 is such that the ratio between the amplitude $V_0$ of the high voltage signal and the thickness e of the film 40 is less than the dielectric strength of the insulator 40.

For example, in one preferred embodiment, the electrodes system is in the form of a ceramic ($Al_2O_3$, 99%) or FR4 (glass fibers woven and glued in an epoxy matrix) substrate. These materials are inherently electrically insulating and are covered with conducting tracks, typically gold-plated copper, to make electrodes using a photolithography technique. The value of the amplitude of the electrical voltage is $V_0$=800 Volts RMS and its frequency is F=70 kHz. An insulating film 40 made of type C Parylene with a dielectric strength of 270 V/μm is deposited on the set of electrodes 22, 24 with a thickness of e=50 μm, separated from each other by an insulation distance H=300 μm.

It is desirable that the transit time for a straight section of jet 2 should be much greater than the high frequency signal oscillation period 1/F, so as to assure a constant deflection level and therefore optimize the location of the recovery gutter for the ink from the deflected jet. In this way, the attraction of a straight jet section 2 is integrated over several periods 1/F of the high voltage signal and the deflection level is practically independent of the entry time to of any section of jet into the electrostatic field E, in other words regardless of the voltage applied on the first electrode $\mathbf{22}_1$ at the end of the jet 2 at the time of its arrival.

In particular, the length L of the electrodes network 20 (or the dimension of the zone 30 of influence of the electrodes 20) is superior to the ratio between the speed v of the jet 2 and the frequency F of the high voltage signal, such that a significant number of attraction periods is applied to every straight jet section 2. Preferably, the ratio of the length L of the network 20 multiplied by the deflection frequency F to the speed v of the jet 2 will be chosen to be greater than 5: $L \cdot F/v \geqq 5$.

For example, for a jet speed v equal to 10 m/s, a length L of the electrodes network 20 equal to 1 mm and a frequency F of the high voltage signal equal to 100 kHz, the jet 2 is subjected to the electrostatic attraction force about 20 times.

When printing, the jet 2 is broken, for example by a pulse applied to a piezoelectric actuator of the generator 1, and segments 14 are formed. Their deflection amplitude, that will determine the distance between the substrate to be printed 10 and the gutter 8, then also depends on the length 1 of the segment 14 compared with the length L of the set of electrodes 20. For a <<long >> segment 14*a*, in other words that passes through the action zone 30 of the electrodes ($1 \geqq L$), the deflection amplitude increases with the length of the zone of influence 30 of the electrodes 20, in the direction of progress of the jet 2. On the contrary, when the size of the segment 14*b* is typically of the order of magnitude of the height h of an electrode 22, it is no longer possible to form dipoles 36, and the deflection level is almost zero.

Thus, preferably, the length of the jet segments 14*a* said to be deflected and not being used for printing, is greater than or equal to the total height L of the electrodes set 20; the length of the segments 14*b* said to be non-deflected and that will form drops 12 and that will be used for printing is less than the smallest distance H separating two adjacent electrodes $\mathbf{22}_i$, $\mathbf{24}_i$. The length 1 of the segments 14 is given by the interval separating two disturbance signals of the jet 2; for example, it may be adjusted as a function of the duration between two pulses on a piezoelectric actuator. It is thus also possible to modulate the size of the drops 12 as a function of the conditions and the substrate 10, while preferably remaining within the required range ($1 \leqq h$).

Advantageously, the printable segments 14*b* of ink do not carry an electric charge, in other words the liquid is connected to the ground in the reservoir. Preferably, a shielding is also placed at the output from generator 1 facing the nozzles 4 around the jet break up point 2 and is also connected to the ground, so as to completely shield the short segments 14*b* that will be used for printing from the influence of the electric field E.

According to one advantageous embodiment, the jet 2 is broken at a fixed distance from the nozzle 4; for example, this can be done by applying a short strong pulse on a piezoelectric actuator, like that described in patent application FR 05 52758.

The device according to the invention thus makes it possible to produce drops coming from a continuous jet and capable of being printed. Compared with the existing techniques, this principle of printing by jet deflection provides the following advantages:

- Outside of printing situations, the operation of the device is almost static: the functions of stimulation and collection of jets are separated. A stimulation failure of the generator 1 does not prevent the ink jets 2 from being properly collected; moreover, since the jet stimulation device is not constantly fed by an electrical signal, it has a longer lifetime and improved reliability.
- Risks of the high voltage circuit cutting out or poor print quality due to accumulated pollution are very much reduced if not eliminated, which makes the device more reliable. The electric deflection fields E of the jets 2 have a zero mean value in time and limit the accumulation of particles (dust, ink splashes) which is unlike the case when the electrodes 6 are powered at fixed potentials that permanently attract and collect electrically charged pollution present in the environment of the print head.
- The electrodes 22, 24 can be protected by a dielectric 40 while acting on the ink jets 2. The electrically insulating layer 40 thus eliminates all risks of a short circuit between the electrodes 22, 24 and a ground point due to the accidental formation of a conducting liquid bridge (pollution, etc.). The resulting safety is incomparably better, and the additional cost of a circuit cutting out device that is essential when the ink is inflammable is eliminated.
- The printer head is very tolerant to the presence of ink on the insulator 40. This advantage is of overriding importance during start/stop sequences of the jets 2 that often cause pollution of elements of the print head. A droplet of ink placed on the insulator 40 is at a floating potential that only slightly disturbs the deflection field E. On the other hand, in systems according to prior art that have an electrode 6 at a constant voltage and in which it is impossible to use an insulator 40, the ink drop extends the electrode 6 from which it acquires the potential, locally reinforces electrostatic action on the jet 2 to finally create a liquid bridge between the HV electrode connected to the ground (short circuit).
- Low conductivity fluids can be used, and the jet 2 does not have to be connected to the ground. The rate at which jet segments 14 are charged depends on the redistribution of charges in the jet 2 (to form dipoles 36) and no longer to the transfer of charges from the ground (usually the nozzle plate 4) to the zone 30 of influence of the high voltage electrode.
- All dependence or synchronization between the high voltage control signal of the electrodes 22, 24 (therefore deflection of the jets 2) and the jet break signal (stimulation) can be eliminated due to the lack of any movement of charges in the jet between the nozzle 4 and the electrodes 20.

The length 1 of the jet segment 14 can be adjusted as desired. This provides the possibility of continuously varying the impact diameter of the drops 12 and thus makes it possible to print an image with different grey levels or to maintain the impact diameter on different types of substrates 10.

Time between printing failures is extended, particularly in the case of a set 20 composed of an even number of electrodes such that the field E created by a pair of adjacent electrodes $\mathbf{22}_i$, $\mathbf{24}_i$ compensate each other and cancel out in the environment of the head:

it is easier to shield the jet break up point and thus avoid forming satellite droplets that carry a charge, and can be strongly deviated and disturb the printout, the droplets and mist caused by ink splashes produced by the gutter 8 do not charge and consequently are less polluting (no electrical attraction outside the gutter 8).

The functional elements (shield 16, deflecting electrodes 20, gutter 8) are located on the same side of the jets 2 with respect to the direction defined by the nozzles 4, and the print head is accessible for performing maintenance operations.

The invention claimed is:

1. Method for deflecting a jet of liquid comprising:

formation of a jet of conducting liquid output from a nozzle at a predetermined speed from a pressurized chamber along a hydraulic trajectory, generation of an electric field variable along the hydraulic trajectory by applying a potential to a sequence of several deflecting electrodes along the direction of the hydraulic trajectory, the electrodes being isolated from each other and forming a set extending along an electrodes plane parallel to the hydraulic trajectory over a length of the network, in which the potential applied to each electrode (in the set is variable and the potential applied to all electrodes in the set is of an average in time and in space equal to zero, deflection of the jet by the electric field by mobilization of charges within the jet.

2. Method according to claim 1 in which the set comprises an even number of deflecting electrodes, and in which the potential to two adjacent electrodes is of an average equal to zero.

3. Method according to claim 1 in which the jet output from the nozzle is connected to the ground.

4. Method according to claim 1 which the hydraulic trajectory is spaced from the electrodes plane of a distance lower or equal to twice the distance between two electrodes of the set.

5. Method according to claim 1 in which the potential applied to each deflection electrode is sinusoidal with the same frequency, and each electrode preferably has the same dimension in the electrodes plane.

6. Method according to claim 5 in which the length (L) of the set of electrodes is superior to the ratio between the ejection speed (v) and the frequency (F) of the applied potential, preferably L.gtoreq.5v/F.

7. Method for selective deflection of segments of a continuous jet including a method of deflecting the jet according to claim 1 and applying a disturbance to the jet so as to break the jet and generate segments at a jet break up point on the upstream side of the variable electric field such that the jet segments are deviated differently depending on their length.

8. Method according to claim 7 including shielding (16) of the hydraulic trajectory (A) at the break up point, such that the electric field (E) does not act at this point.

9. Method according to claim 7 in which the length of the generated segments is superior to the length of the set of electrodes in the direction of the hydraulic trajectory or less than the dimension separating two electrodes along the direction of the hydraulic trajectory.

10. Method according to claim 7 wherein the perturbation of the jet is performed by means of the activation of piezoelectric means placed at the level of the chamber of liquid.

11. Method for generating a curtain of drop jets comprising independent simultaneous projection by a multitude of nozzles of jet, the production of segments by disturbance of the jet and the selective deflection of the segments using a method according to claim 7, the undeviated segments generating drops along the hydraulic trajectory.

12. Generation method according to claim 11, wherein the electrodes generating the electric field and/or the shielding are common to all of the jets.

13. Ink jet printing method including the generation of drops along a hydraulic trajectory deflected with respect to the jet from which they derivate by the method according to claim 7 and the collection of jet segments deflected by the electric field.

14. Device for selective deviation of drops of conducting liquid comprising:

a reservoir of pressurized liquid comprising at least one liquid ejection nozzle in the form of a continuous jet along a hydraulic trajectory given by the axis of the nozzle, means of disturbing the jet and breaking it at a jet break up point, a set extending along an electrodes plane, comprising several deflecting electrodes positioned on the downstream side of the break up point, the electrodes being positioned in sequence one after the other and isolated from each other in the direction of the hydraulic trajectory, means to apply a variable potential to each electrode, the means being adapted so that the potential applied to the network of electrodes is of an average in time and in space equal to zero, such that the jet is deviated from its hydraulic trajectory by the field created when applying the potential to electrodes.

15. Device according to claim 14 in which the distance between the hydraulic trajectory and the network of electrodes is less than or equal to twice the distance between two adjacent electrodes in the network.

16. Device set forth in claim 14 also comprising an insulating film on the network of electrodes.

17. Device according to claim 14 in which the network comprises an even number of electrodes and the means are adapted to apply a potential with a phase shift of 180.degree. between two consecutive electrodes.

18. Device according to claim 14 comprising shield means extending along the trajectory of the jet starting at the break up point.

19. Device according to claim 14 including a plurality of nozzles enabling a curtain of jets to be produced, the electrodes set being unique for the curtain of jets.

20. Device according to claim 14 wherein the means for disturbing the jet include a piezoelectric actuator at the level of each chamber.

21. Print head including a device according to claim 14 and means for collecting the ink of the deflected jet.

* * * * *